US012655702B2

(12) United States Patent
Eitschberger

(10) Patent No.: US 12,655,702 B2
(45) Date of Patent: Jun. 16, 2026

(54) ADAPTER ASSEMBLY FOR USE WITH A WELLBORE TOOL STRING

(71) Applicant: DynaEnergetics Europe GmbH, Troisdorf (DE)

(72) Inventor: Christian Eitschberger, Munich (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 19/297,689

(22) Filed: Aug. 12, 2025

(65) Prior Publication Data

US 2025/0369296 A1 Dec. 4, 2025

Related U.S. Application Data

(63) Continuation of application No. 18/477,968, filed on Sep. 29, 2023, now Pat. No. 12,410,669, which is a continuation of application No. 17/545,147, filed on Dec. 8, 2021, now Pat. No. 11,814,915, which is a continuation of application No. 17/181,280, filed on Feb. 22, 2021, now Pat. No. 11,225,848, said application No. 18/477,968 is a continuation-in-part of application No. 29/735,905, filed on May 26, 2020, now Pat. No. Des. 1,041,608.

(60) Provisional application No. 62/992,643, filed on Mar. 20, 2020.

(51) Int. Cl.
*E21B 23/10* (2006.01)
*E21B 17/046* (2006.01)

(52) U.S. Cl.
CPC ..... *E21B 23/10* (2013.01); *E21B 17/046* (2013.01)

(58) Field of Classification Search
CPC ..... E21B 23/10; E21B 17/046; E21B 17/02; E21B 43/117
See application file for complete search history.

(56) References Cited

U.S. PATENT DOCUMENTS 579,643 A * 3/1897 Gleason ..... F16L 19/0212 285/330
2,766,999 A * 10/1956 Watts ..... F16L 23/20 285/341
4,007,796 A * 2/1977 Boop ..... E21B 43/1185 102/306
4,266,613 A * 5/1981 Boop ..... F42D 1/04 200/82 R
4,624,483 A * 11/1986 Stromberg ..... E21B 19/06 285/348
6,333,699 B1 * 12/2001 Zierolf ..... E21B 17/006 705/65

(Continued)

*Primary Examiner* — Yanick A Akaragwe
(74) *Attorney, Agent, or Firm* — Womble Bond Dickinson (US) LLP

(57) ABSTRACT

An adapter assembly for use with a wellbore tool string. The adapter assembly may include a tandem seal adapter (TSA) and a collar. The TSA has a TSA body extending along an axial direction and a TSA rib may extend radially outward from the TSA body in a radial direction substantially perpendicular to the axial direction. The collar may be provided outward from the TSA in the radial direction. The collar may include a collar body extending along an axial direction and a collar rib extending radially inward from the collar body in the radial direction. The collar rib is positioned between the TSA rib and a housing of a wellbore tool in the axial direction.

20 Claims, 10 Drawing Sheets

(56) References Cited

U.S. PATENT DOCUMENTS

| | | | | |
|---|---|---|---|---|
| 7,278,491 | B2 * | 10/2007 | Scott | E21B 43/119 166/380 |
| 9,702,680 | B2 * | 7/2017 | Parks | E21B 43/11855 |
| 11,339,614 | B2 * | 5/2022 | Mulhern | E21B 17/028 |
| 11,408,279 | B2 * | 8/2022 | Zemla | E21B 23/10 |
| 2004/0216866 | A1 * | 11/2004 | Barlow | E21B 43/119 166/55 |
| 2016/0040509 | A1 * | 2/2016 | Castillo | E21B 17/028 166/244.1 |
| 2016/0168961 | A1 * | 6/2016 | Parks | E21B 43/117 102/306 |
| 2016/0273902 | A1 * | 9/2016 | Eitschberger | F42D 1/05 |
| 2020/0362676 | A1 * | 11/2020 | Goyeneche | F42B 3/02 |
| 2021/0207934 | A1 * | 7/2021 | Sullivan | E21B 43/1185 |

* cited by examiner

ADAPTER ASSEMBLY FOR USE WITH A WELLBORE TOOL STRING

CROSS-REFERENCE TO RELATED APPLICATIONS

This application is a continuation of and claims priority to U.S. patent application Ser. No. 18/477,968 filed Sep. 29, 2023, which is a continuation of U.S. patent application Ser. No. 17/545,147 filed Dec. 8, 2021, which is a continuation of U.S. patent application Ser. No. 17/181,280 filed Feb. 22, 2021, which is a continuation-in-part of U.S. Design patent application Ser. No. 29/735,905, filed May 26, 2020 and claims priority to U.S. Provisional Application No. 62/992,643 filed Mar. 20, 2020, the contents of each of which are incorporated herein by reference.

BACKGROUND

Wellbore tools used in oil and gas operations are often sent down a wellbore in tool strings including multiple discrete wellbore tools, or modules, connected together to consolidate different or multiple wellbore operations into a single "run," or process of sending wellbore tools downhole to perform one or more operations. This approach contributes to time and cost savings because preparing and deploying a wellbore tool into a wellbore and pumping, with fluid under hydraulic pressure, the wellbore tool to a particular location in a wellbore (that may be a mile or more under the ground) requires a great deal of time, energy, and manpower. Additional time, manpower, and costs are required to conduct the operation and remove the spent wellbore tool(s) from the wellbore.

Wellbore tools may include, without limitation, perforating guns, puncher guns, logging tools, jet cutters, plugs, frac plugs, bridge plugs, setting tools, self-setting bridge plugs, self-setting frac plugs, mapping/positioning/orientating tools, bailer/dump bailer tools and ballistic tools. Many of these wellbore tools contain sensitive or powerful explosives because many wellbore tools are ballistically (i.e., explosively) actuated or perform ballistic operations within the wellbore. Additionally, certain wellbore tools may include sensitive electronic control components and connections that control various operations of the wellbore tool. Explosives, control systems, and other components of wellbore tools may be sensitive to conditions within the wellbore including the high pressures and temperatures, fluids, debris, etc. In addition, wellbore tools that have explosive activity may generate tremendous amounts of ballistic and gas pressures within the wellbore tool itself. Accordingly, to ensure the integrity and proper operation of wellbore tools connected together as part of the tool string, connections between adjacent wellbore tools within the tool string may not only connect adjacent wellbore tools in the tool string, they may, in many cases, seal internal components of the wellbore tools from the wellbore conditions and pressure isolate adjacent modules against ballistic forces.

A tandem seal adapter (TSA) is a known connector often used for accomplishing the functions of a connector as described above, and in particular for connecting adjacent perforating gun modules. A perforating gun is an exemplary, though not limiting, wellbore tool that may include many of the features and challenges described above. A perforating gun carries explosive charges into the wellbore to perform perforating operations by which the shaped charges are detonated in a manner that produces perforations in a surrounding geological hydrocarbon formation from which oil and gas may be recovered. Conventional perforating guns often include electric componentry to control positioning and detonation of the explosive charges.

In conventional systems, problems may arise in that the mechanical coupling between consecutive wellbore tools has insufficient strength. Additionally, conventional connectors may undesirably increase the length of the wellbore tool string. For example, a conventional connector may include both sealing elements and mechanical coupling components on the same part. However, as the sealing elements and coupling components must be axially separated, this increases the overall axial length of the connector, which in turn increases the length of the tool string.

Accordingly, it may be desirable to develop a tandem seal adapter, adapter assembly, and wellbore tool string that helps to strength mechanical coupling between components, shortens the length of the tool string, and may be produced more efficiently and inexpensively.

BRIEF DESCRIPTION

In an aspect, the exemplary embodiments include an adapter assembly for use with a wellbore tool string. The adapter assembly may include a (TSA). The TSA may include a TSA body extending along an axial direction from a first end of the TSA body to a second end of the TSA body, and a TSA rib extending radially outward from the TSA body in a radial direction substantially perpendicular to the axial direction. The adapter assembly may further include a collar. The collar may be provided outward from the TSA in the radial direction. The collar may include a collar body extending along an axial direction from a first end of the collar body to a second end of the collar body, and the collar body may be formed in a substantially annular shape. The collar may include a collar rib extending radially inward from the collar body in the radial direction. The collar rib may be positioned between the TSA rib and a housing of a wellbore tool in the axial direction.

In an aspect, the exemplary embodiments include an adapter assembly for use with a wellbore tool string. The adapter assembly may include a (TSA). The TSA may include a TSA body extending along an axial direction from a first end of the TSA body to a second end of the TSA body, and a TSA rib extending radially outward from the TSA body in a radial direction substantially perpendicular to the axial direction. The TSA rib may also include a TSA rib wall extending in the radial direction, and the TSA rib wall may define a TSA rib wall surface. The adapter assembly may also include a collar. The collar may be provided outward from the TSA in the radial direction. The collar may include a collar body extending along an axial direction from a first end of the collar body to a second end of the collar body. The collar body may be formed in a substantially annular shape. A collar rib may extend radially inward from the collar body in the radial direction. The collar rib may include a first end surface and a second end surface spaced apart from the first end surface in the axial direction, and the TSA rib wall surface and the second end surface of the collar rib may be in a facing relationship in the axial direction. The first end surface of the collar rib may be adjacent to a housing of a wellbore tool in the axial direction.

In an aspect, the exemplary embodiments include an adapter assembly for use with a wellbore tool string. The adapter assembly may include a TSA. The TSA may include a TSA body extending along an axial direction from a first end of the TSA body to a second end of the TSA body, and a TSA rib extending radially outward from the TSA body in a radial direction substantially perpendicular to the axial direction. The adapter assembly may also include a collar. The collar may be provided outward from the TSA in the radial direction. The collar may include a collar body extending along an axial direction from a first end of the collar body to a second end of the collar body. The collar body may be formed in a substantially annular shape, and a collar rib may extend radially inward from the collar body in the radial direction. The collar rib may be positioned between the TSA rib and a housing of a wellbore tool in the axial direction, and the housing, may overlap the first end of the TSA body.

BRIEF DESCRIPTION OF THE SEVERAL VIEWS OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
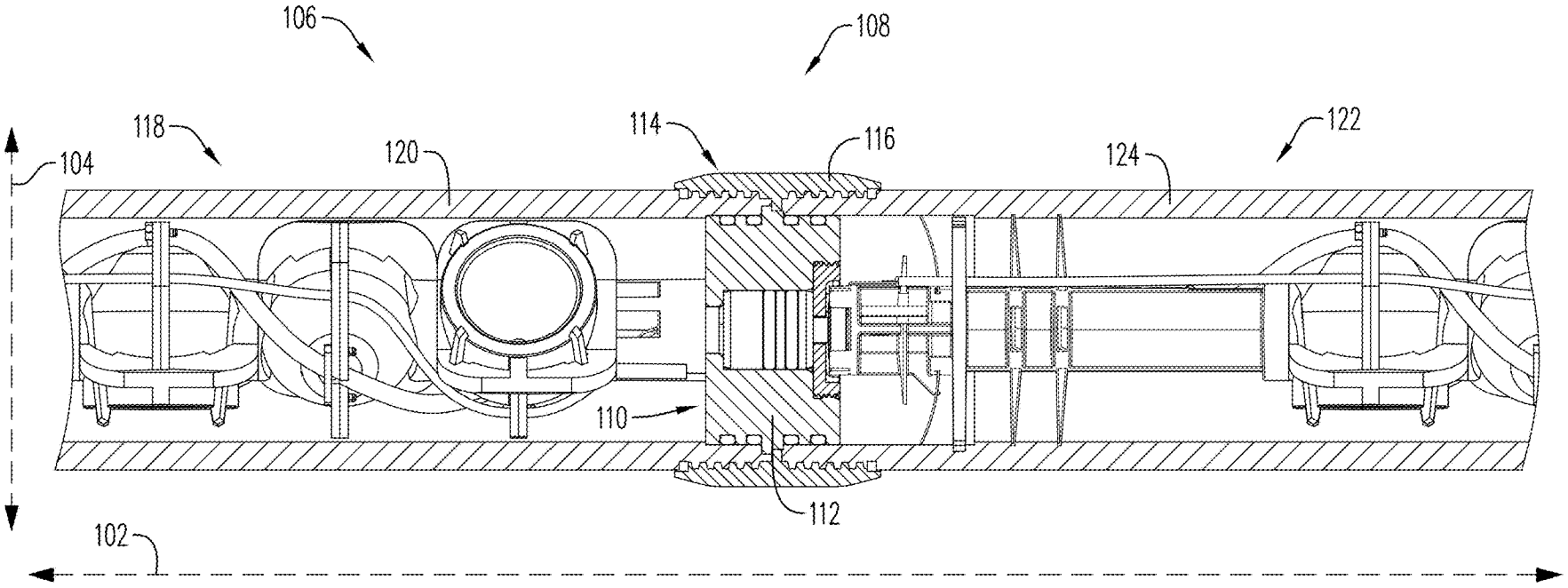
FIG. 1 is a cross-section view of a wellbore tool string according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

DETAILED DESCRIPTION

Reference will now be made in detail to various exemplary embodiments. Each example is provided by way of explanation and is not meant as a limitation and does not constitute a definition of all possible embodiments.

The present disclosure may use the term "substantially" in phrases including, but not limited to, "substantially annular shape," "substantially parallel," and "substantially perpendicular," hereinafter summarized as "substantially [x]." In the context of this disclosure, the phrase "substantially [x]" is meant to include both "precisely [x]" and deviations from "precisely [x]" such that the structure would function, from the perspective of one of ordinary skill in the art, in the same way as if it were "precisely [x]." The word "substantially" is not itself limiting but would be readily understood by a person of ordinary skill in the art in view of the exemplary embodiments described in this disclosure and shown in the figures.

FIG. 1 shows an exemplary embodiment of an adapter assembly 108 for use in a wellbore tool string 106. The wellbore tool string 106 may include a first wellbore tool 118 having a first housing 120, a second wellbore tool 122 having a second housing 124, and the adapter assembly 108. The adapter assembly 108 may be configured to mechanically and electrically couple the first wellbore tool 118 to the second wellbore tool 122. Additionally, the adapter assembly 108 may be configured to sealingly isolate the first wellbore tool 118 from the second wellbore tool 122 with regard to fluid and pressure penetration. Additionally, the adapter assembly 108 may be configured to sealingly isolate the first wellbore tool 118 and the second wellbore tool 122 from fluids and pressure exterior to the wellbore tool string 106.

The adapter assembly 108 may include a tandem seal adapter (TSA 110) comprising a TSA body 112. The TSA body 112 may extend along an axial direction 102. In an exemplary embodiment, the TSA body 112 may have a total length of 1 inch or less in the axial direction 102. The adapter assembly 108 may further include a collar 114. The collar 114 may include a collar body 116 formed in a substantially annular shape. The collar body 116 may extend in the axial direction 102. The collar 114 may be provided outward from the TSA 110 in a radial direction 104, the radial direction 104 being substantially perpendicular to the axial direction 102. The TSA 110 and the collar 114 may overlap in the axial direction 102.

Figure 2B:
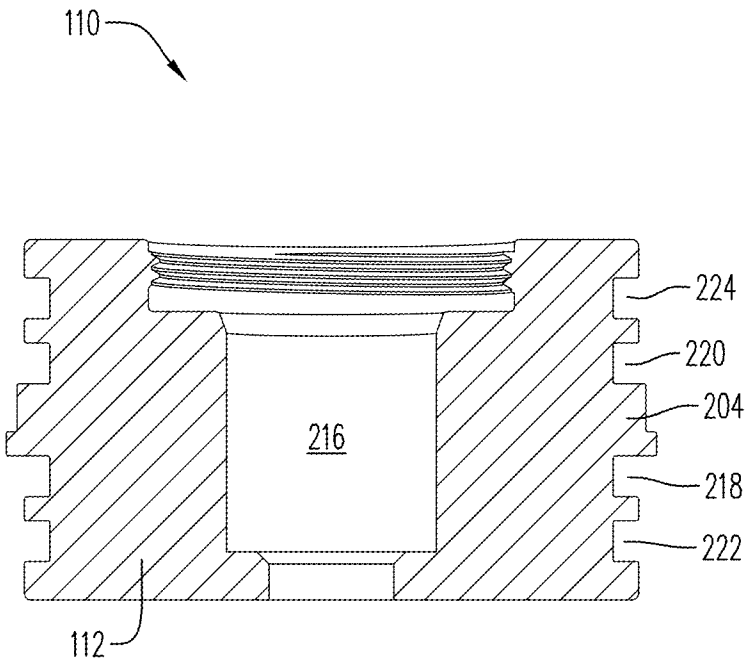
FIG. 2B is a cross-section view of a tandem seal adapter according to an exemplary embodiment.
Figure 2A:
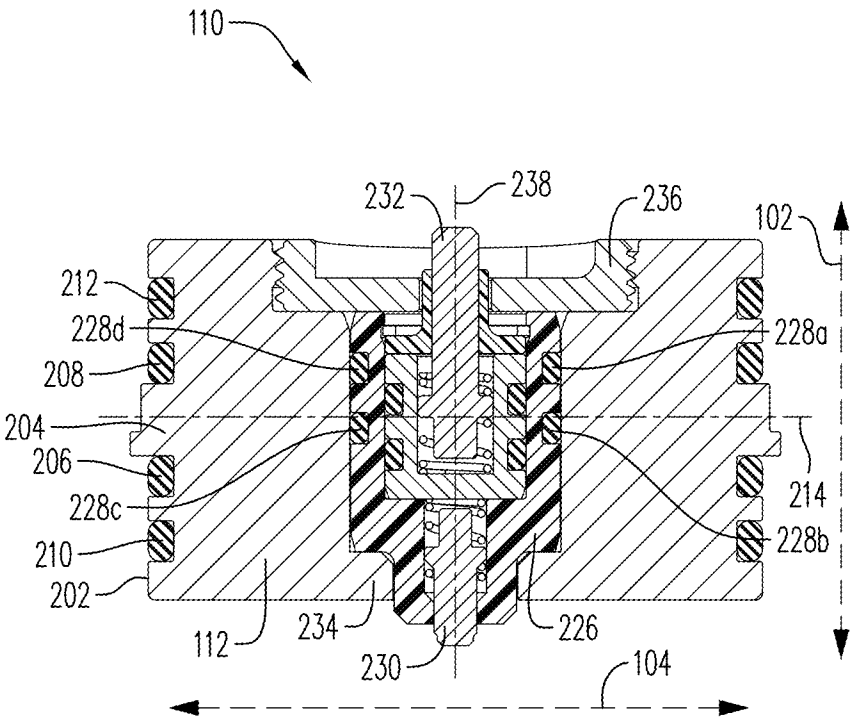
FIG. 2A is a cross-section view of a tandem seal adapter according to an exemplary embodiment.

FIG. 2A and FIG. 2B illustrate an exemplary embodiment of the TSA 110. The TSA 110 may include a TSA rib 204 extending radially outward from the TSA body 112 in the radial direction 104. Further details of the TSA rib 204 will be discussed herein with reference to FIG. 5 and FIG. 7.

As seen in FIG. 2A, the TSA 110 may include sealing elements provided on an outer surface 202 of the TSA body 112. In the example shown in FIG. 2A, the sealing elements may include a first seal 206, a second seal 208, a third seal 210, and a fourth seal 212. However, it will be understood that the specific number of seals may be variable to suit a particular application. In an exemplary embodiment, the first seal 206, the second seal 208, the third seal 210, and the fourth seal 212 may be o-rings. The first seal 206, the second seal 208, the third seal 210, and the fourth seal 212 may be respectively provided within a First TSA seal groove 218, a Second TSA seal groove 220, a Third TSA seal groove 222, and a Fourth TSA seal groove 224 formed in the outer surface 202 of the TSA body 112 (see FIG. 2B).

As seen in FIG. 2A, the first seal 206 and the third seal 210 may be provided to a first side of a TSA center 214 (approximate position of the TSA center 214 is shown by the broken line in FIG. 2A), and the second seal 208 and the fourth seal 212 may be provided to a second side of the TSA center 214.

FIG. 2B shows an exemplary embodiment of the TSA 110, which may further include a bore 216 extending through the TSA body 112. Returning to FIG. 2A, a bulkhead 226 may be provided within the bore 216. Exemplary embodiments of the bulkhead 226 are described in U.S.

patent application Ser. No. 16/819,270, filed Mar. 16, 2020, which is herein incorporated by reference to the extent that it does not conflict with the present application. The bulkhead 226 may sealingly isolate the first wellbore tool 118 from the second wellbore tool 122, for example via bulkhead seals 228*a*, 228*b*, 228*c*, 228*d*.

The bulkhead 226 may include a first electrical contact 230 and a second electrical contact 232 that are in electrical communication through an interior of the bulkhead 226. The first electrical contact 230 is configured to contact a component within the first wellbore tools 118, and the second electrical contact 232 is configured to contact a component with the second wellbore tool 122, thereby providing electrical communication between the first wellbore tool 118 and the second wellbore tool 122 through the TSA 110.

The bulkhead 226 may be retained in the bore 216 by abutting with an interior shoulder 234 of the TSA body 112 at a first end. A retainer nut 236 may be used to retain the bulkhead 226 within the bore 216 at a second end. The retainer nut 236 may be threadedly engaged with the TSA body 112. It will be understood that other structures may be used in place of the retainer nut 236, such as a C-clip or a retainer ring.

Figure 3:
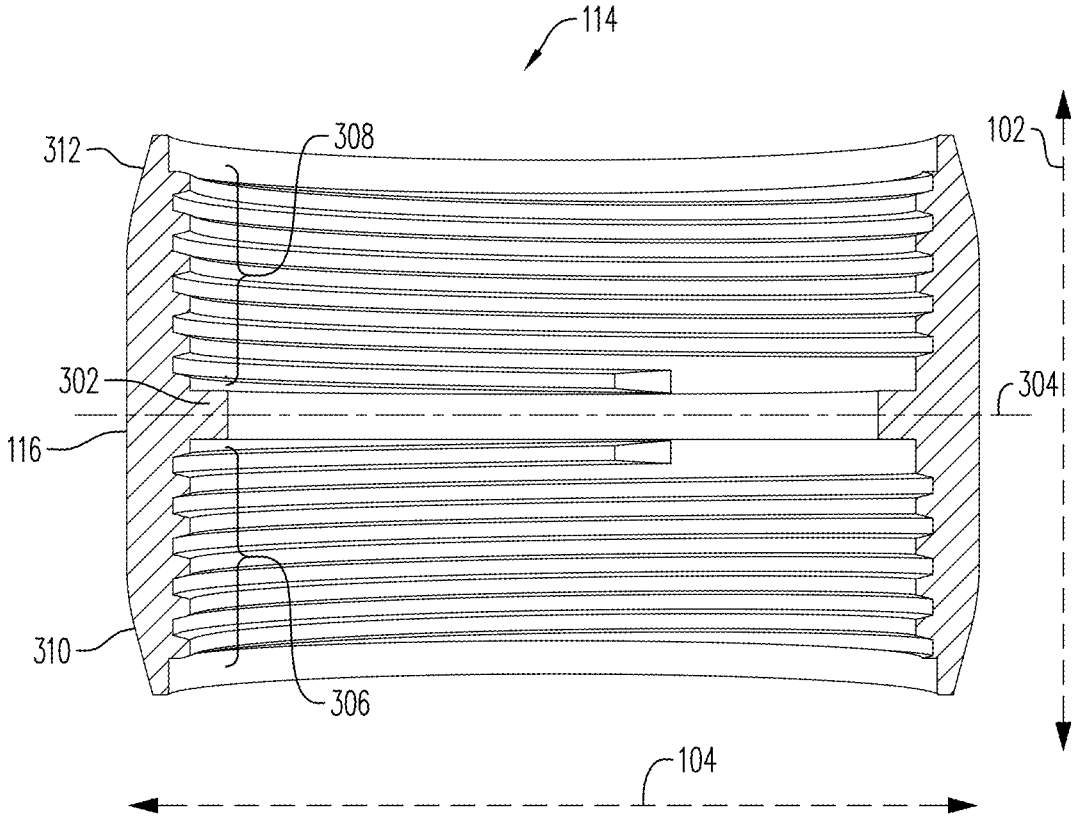
FIG. 3 is a cross-section view of a collar according to an exemplary embodiment.

FIG. 3 illustrates an exemplary embodiment of the collar 114. The collar 114 may include a collar rib 302 extending radially inward from the collar body 116 in the radial direction 104. The collar 114 may further include a first collar coupling 306 and a second collar coupling 308. In an exemplary embodiment, the first collar coupling 306 and the second collar coupling 308 may be provided on an interior surface of the collar body 116. The first collar coupling 306 and the second collar coupling 308 may be embodied as threads formed on the interior surface of the collar body 116. The first collar coupling 306 may be provided to a first side of a collar center 304 in the axial direction 102 (approximate location of the collar center 304 is indicated by the broken line). The second collar coupling 308 may be provided to a second side of the collar center 304 in the axial direction 102.

In an exemplary embodiment, the collar 114 may have a maximum outer diameter of about 3.5 inches at the collar center 304. The collar may further include a first sloped portion 310 and a second sloped portion 312 where an outer diameter of the collar 114 decreases as distance from the collar center 304 increases. This may help to provide a tapered profile at ends of the collar 114 that help to prevent or reduce friction, shock, and damage in the event of impact with a wellbore casing during a pump-down operation.

Additionally, as the outer diameter of the collar 114 may be larger than an outer diameter of connected wellbore tools, the collar 114 may help to prevent contact between the wellbore tools and the wellbore casing, thereby reducing the chance of contact and damage to both the wellbore tools and the wellbore casing. Additionally, larger diameter of the collar 114 may help to centralize wellbore tools within the wellbore, thereby resulting in more consistent diameters of perforations into the surrounding formations.

Figure 4A:
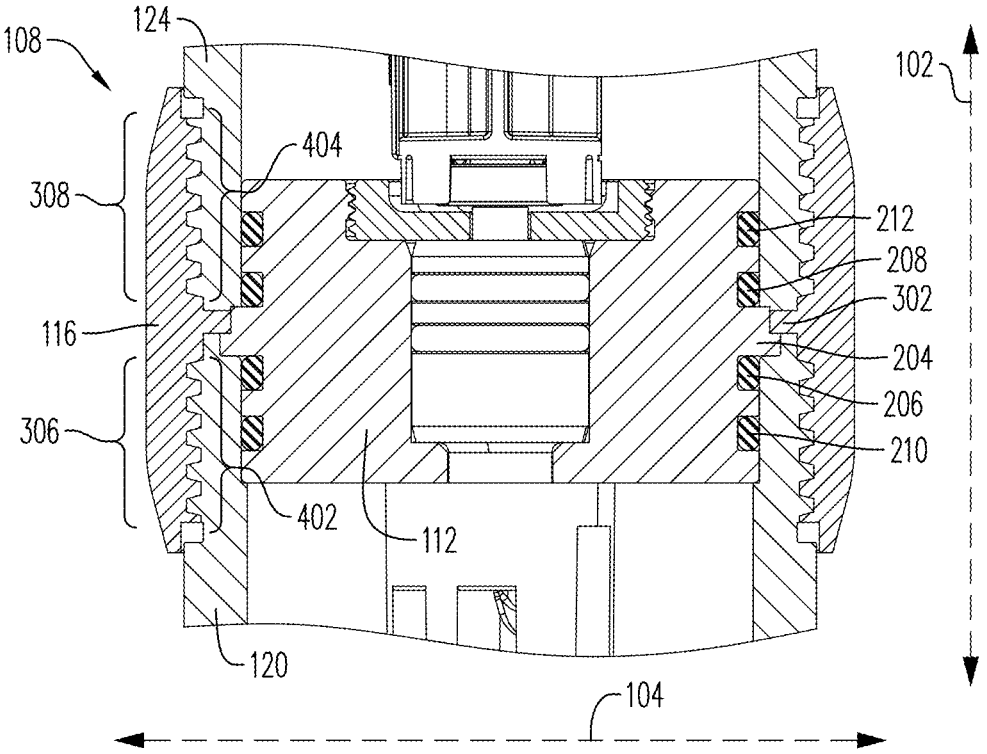
FIG. 4A is an enlarged cross-section view of a wellbore tool string according to an exemplary embodiment.

FIG. 4A is an enlarged cross-section view showing adapter assembly 108. In an exemplary embodiment, the TSA rib 204 and the collar rib 302 may overlap in the axial direction 102. Additionally, the TSA rib 204 and the collar rib 302 may overlap in the radial direction 104. The first seal 206 and the third seal 210 may overlap with the first collar coupling 306 in the axial direction 102, and the second seal 208 and the fourth seal 212 may overlap with the second collar coupling 308 in the axial direction 102. As further seen in FIG. 4A, the first housing 120 may be provided between the first seal 206 and the first collar coupling 306 in the radial direction 104. Additionally, the second housing 124 may be provided between the second seal 208 and the second collar coupling 308 in the radial direction 104.

As further seen in FIG. 4A, a portion of the first housing 120 may be provided between the TSA body 112 and the collar body 116 in the radial direction 104. The first housing 120 of the first wellbore tool 118 may abut one or more of the TSA rib 204 and the collar rib 302. Similarly, a portion of the second housing 124 may be provided between the TSA body 112 and the collar body 116 in the radial direction 104. The second housing 124 of the second wellbore tool 122 may abut one or more of the TSA rib 204 and the collar rib 302. The first housing 120 may include a first tool coupling 402 provided on an outer surface of the first housing 120. Similarly, the second housing 124 may include a second tool coupling 404 provided on an outer surface of the second housing 124. In an exemplary embodiment, the first tool coupling 402 and the second tool coupling 404 may be threads respectively formed on the outer surfaces of the first housing 120 and the second housing 124. The first tool coupling 402 may be configured to engage with the first collar coupling 306 to mechanically couple the first housing 120 to the collar body 116 of the collar 114. Similarly, the second tool coupling 404 may be configured to engage with the second collar coupling 308 to mechanically couple the second housing 124 to the collar body 116 of the collar 114. When the first tool coupling 402 is engaged with the first collar coupling 306, the first seal 206 and the third seal 210 may overlap with both the first tool coupling 402 and the first collar coupling 306 in the axial direction 102. Similarly, when the second tool coupling 404 is engaged with the second collar coupling 308, the second seal 208 and the fourth seal 212 may overlap with both the second tool coupling 404 and the second collar coupling 308 in the axial direction 102.

Using the adapter assembly 108 to connect the first wellbore tool 118 and the second wellbore tool 122 (see FIG. 1) may help to decrease the overall length of the wellbore tool string 106. For example, in an exemplary embodiment, the adapter assembly 108 includes separate pieces such as the TSA 110 and the collar 114. By providing the sealing elements (such as the first seal 206, the second seal 208, the third seal 210, and the fourth seal 212) on the TSA 110 and the coupling elements (such as the first collar coupling 306 and the second collar coupling 308) on the collar 114, the sealing elements and the coupling elements can overlap in the axial direction 102, instead of having to be axially displaced from each other. Accordingly, the overall length of the adapter assembly 108 may be shortened compared with conventional devices. This may allow for shorting of the entire wellbore tool string 106.

Figure 4B:
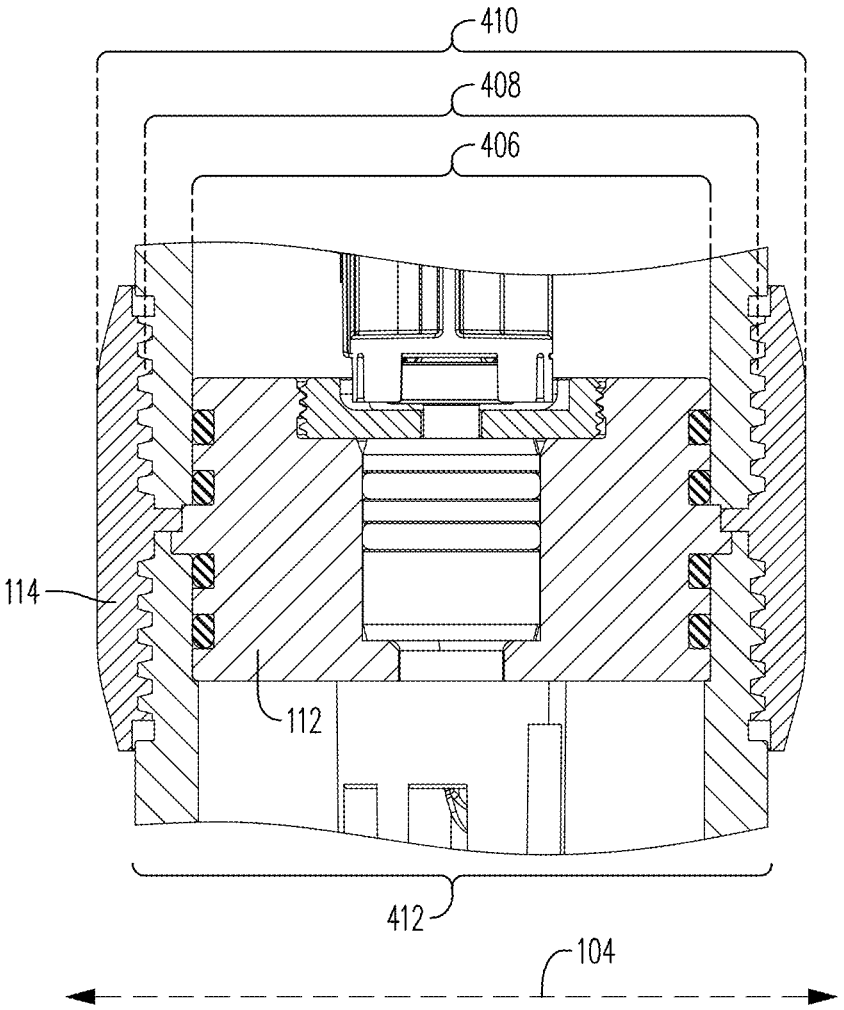
FIG. 4B is an enlarged cross-section view of a wellbore tool string according to an exemplary embodiment.

FIG. 4B shows the relative dimensions of exemplary embodiments of the TSA body 112, the collar 114, and the first housing 120. A TSA body diameter 406 in the radial direction 104 may be smaller than an inner collar diameter 408 in the radial direction 104. An outer collar diameter 410, i.e., an outer adapter assembly diameter, in the radial direction 104 may be larger than an outer tool diameter 412, i.e., an outer first housing diameter, in the radial direction 104. In an exemplary embodiment, the outer collar diameter 410 may be 3.5 inches and the outer tool diameter 412 may be 3.125 inches.

The relative dimensions of the outer collar diameter 410 and the outer tool diameter 412 may help to improve efficiency during pump-down operations of the wellbore tool string 106. For example, because the outer collar diameter 410 is larger than the outer tool diameter 412, the surface area of the wellbore tool string 106 in contact with an inner surface of the wellbore is reduced, thereby reducing surface friction that may acting in opposition to the pump-down operation, especially in applications where the wellbore has a horizontal component with respect to gravity. Further, the differential between the outer collar diameter 410 and the outer tool diameter 412 provides an increased cross-sectional surface area for wellbore fluid to press against during a pump-down operation. In an exemplary embodiment in which the wellbore tools are perforating guns, the outer tool diameter 412 may increase and approach the outer collar diameter 410 following firing of the perforation guns due to gun swell. This may reduce the cross-sectional surface area to facilitate withdrawal of the wellbore tool string 106 from the wellbore.

Figure 5:
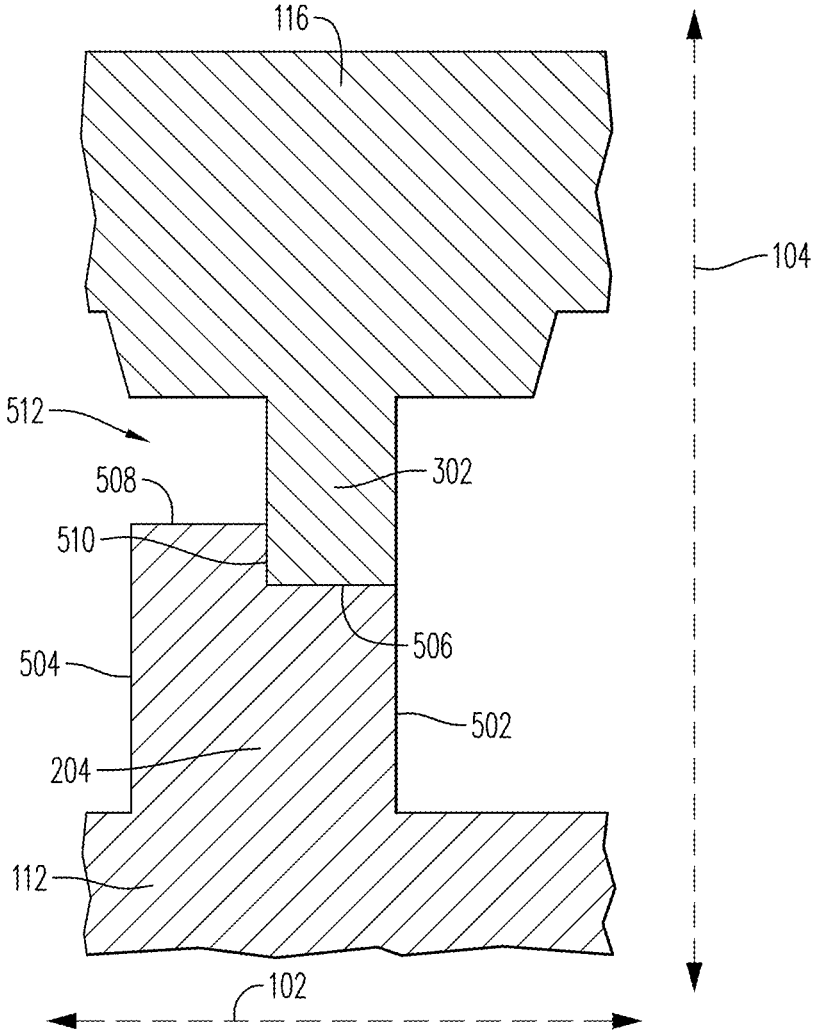
FIG. 5 is an enlarged cross-section view of an adapter assembly according to an exemplary embodiment.

FIG. 5 shows an enlarged cross-section view of an exemplary embodiment of the TSA rib 204 and the collar rib 302. As seen in FIG. 5, the TSA rib 204 has a stepped profile when viewed in cross-section, in other words, when viewed along a plane intersecting with a central axis 238 of the TSA 110. For example, the TSA rib 204 may include a first TSA rib wall 502 extending radially outward from the TSA body 112 in the radial direction 104. The TSA rib 204 may further include a second TSA rib wall 504 extending radially outward from the TSA body 112, with the second TSA rib wall 504 being spaced apart from the first TSA rib wall 502 in the axial direction 102. The TSA rib 204 may further include a first TSA rib step surface 506 extending from the first TSA rib wall 502 in the axial direction 102 toward the second TSA rib wall 504. The TSA rib 204 may further include a second TSA rib step surface 508 extending from the second TSA rib wall 504 in the axial direction 102 toward the first TSA rib wall 502. The first TSA rib step surface 506 and the second TSA rib step surface 508 may be spaced apart in the radial direction 104. The TSA rib 204 my further include a third TSA rib wall 510 extending in the radial direction 104 from the first TSA rib step surface 506 to the second TSA rib step surface 508.

As further seen in FIG. 5, the collar rib 302 and the third TSA rib wall 510 may overlap in the radial direction 104, and the collar rib 302 and the first TSA rib step surface 506 may overlap in the axial direction 102. The collar rib 302 may abut one or more of the first TSA rib step surface 506 and the third TSA rib wall 510. The second TSA rib step surface 508, the collar rib 302, and the collar body 116 may define a recess 512 for receiving a portion of the first housing 120.

Figure 6:
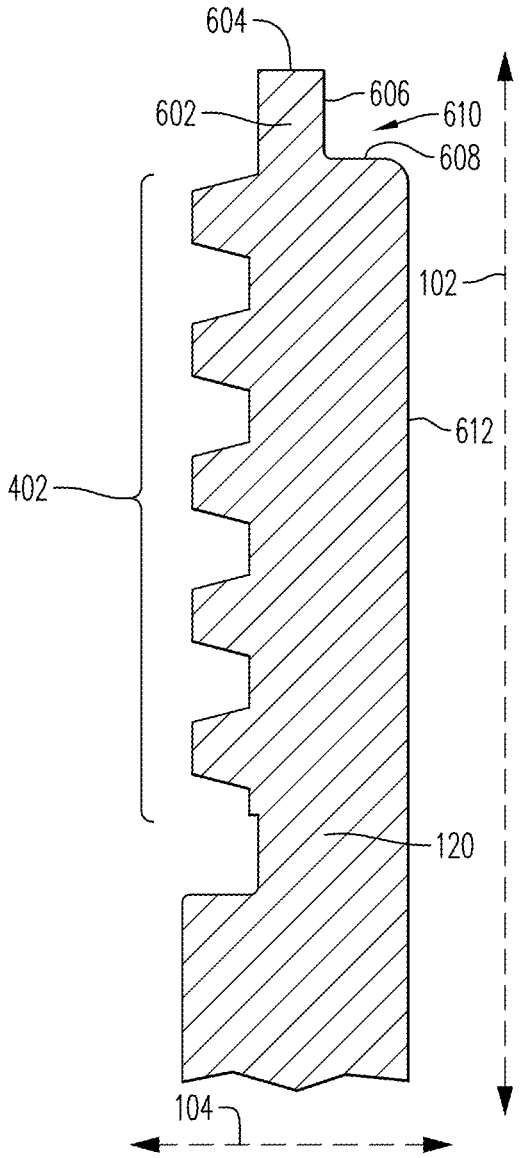
FIG. 6 is an enlarged cross-section view of a wellbore tool housing according to an exemplary embodiment.

FIG. 6 shows an enlarged cross-section view of the first housing 120 according to an exemplary embodiment. The first housing 120 may include a first housing rim 602 provided at a first end of the first housing 120. The first housing rim 602 may be defined in part by a first end surface 604 substantially parallel to the radial direction 104 and a first axial surface 606 extending from the first end surface 604 substantially parallel to the axial direction 102. The first housing rim 602 may be received in the recess 512 (see FIG. 5). The first housing 120 may further include a first tool step surface 608 extending radially inward from the first axial surface 606. The first axial surface 606 and the first tool step surface 608 may define a tool groove 610 formed in a first housing inner surface 612 of the first housing 120.

Figure 7:
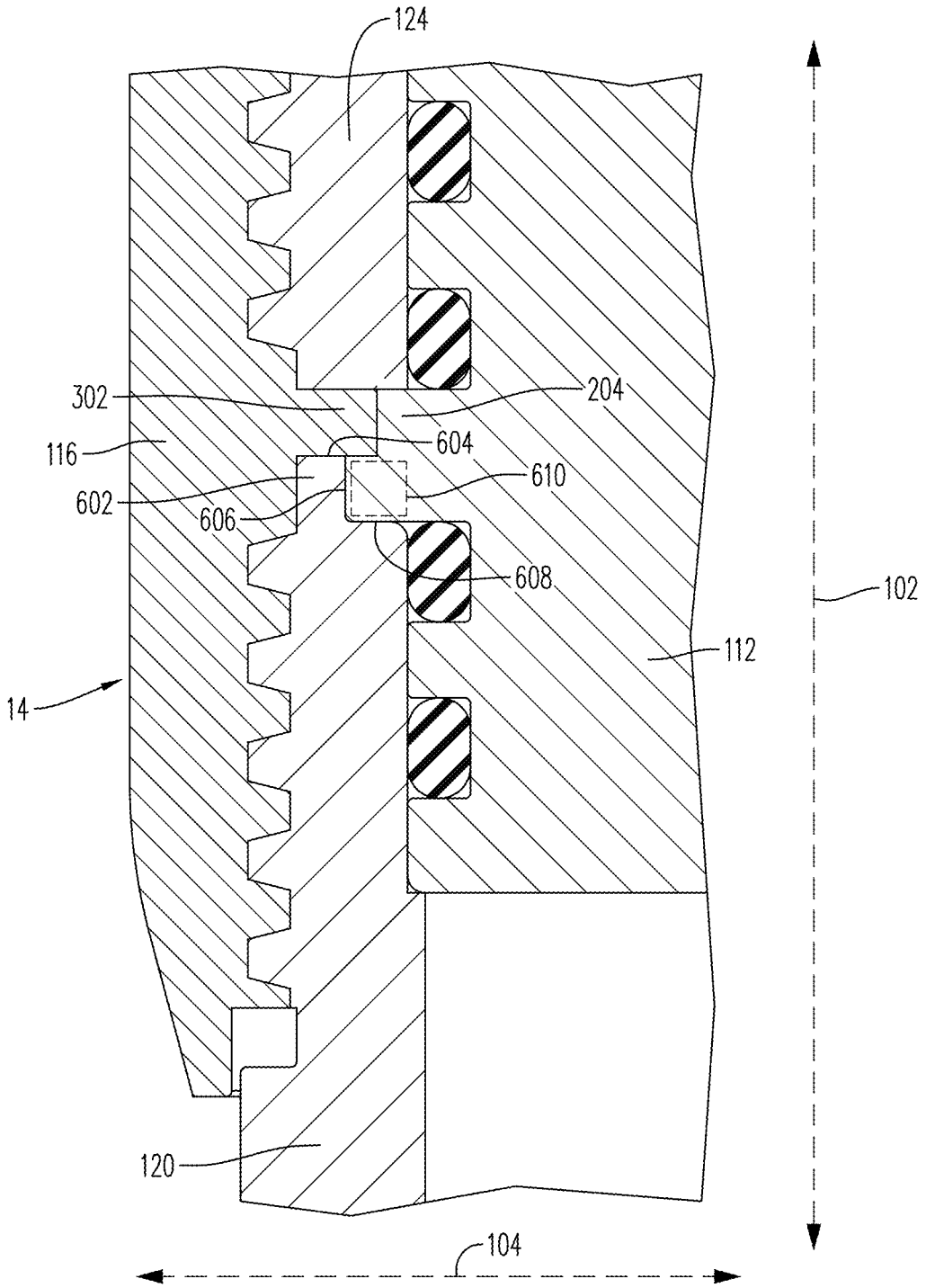
FIG. 7 is an enlarged cross-section view of a wellbore tool string according to an exemplary embodiment.

FIG. 7 shows an enlarged cross-section view illustrating the region of the TSA rib 204, the collar rib 302, and the first housing rim 602. As seen in FIG. 7, at least a portion of the TSA rib 204 is received in the tool groove 610. The first end surface 604 may abut against the collar rib 302. One or more of the first axial surface 606 and the first tool step surface 608 may abut against the TSA rib 204. As can be seen in FIG. 7, at least a portion of the TSA rib 204 may be interposed between the collar rib 302 and the first tool step surface 608 of the first housing 120 in the axial direction 102. This may help to lock the TSA 110 in place and prevent movement of the TSA 110 in the axial direction 102, thereby helping to maintain stable mechanical and electrical connections between the first wellbore tool 118 and the second wellbore tool 122 (see FIG. 1).

Additionally, as seen in FIG. 7, the collar body 116 of the collar 114 is provided radially outward from the first housing 120, with the first housing 120 being interposed between the collar 114 and the TSA body 112. Similarly, the second housing 124 may be interposed between the 114 and the TSA body 112. This may help to strengthen the mechanical coupling between the first wellbore tool 118 and the second wellbore tool 122 (see FIG. 1), thereby reducing the risk of damage, breakage, and/or separation during wellbore operations.

Figure 8:
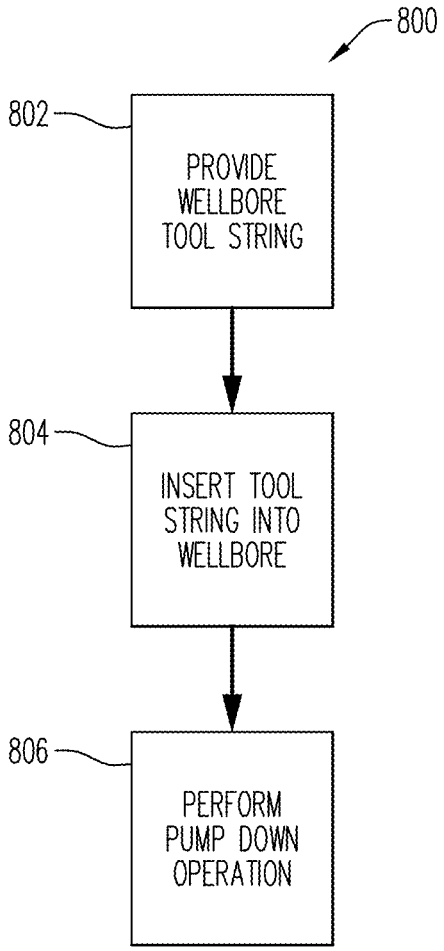
FIG. 8 is a flowchart illustrating a method of using a wellbore tool string according to an exemplary embodiment.

FIG. 8 shows an exemplary embodiment of a method 800 for using a wellbore tool string such as the wellbore tool string 106 (see FIG. 1). In block 802, the wellbore tool string 106 is provided. The wellbore tool string 106 may include the first wellbore tool 118, having the first housing 120, and the adapter assembly 108. The adapter assembly 108 may have an adapter diameter in the radial direction 104 (see outer collar diameter 410 in FIG. 4B) that is larger than the outer tool diameter 412. In block 804, the wellbore tool string 106 is inserted into a wellbore. In block 806, a pump-down operation is performed on the wellbore tool string 106 to position the wellbore tool string 106 at a desired position. For example, the desired position may be a position for firing perforating guns.

As noted above, the differential between the outer collar diameter 410 and the outer tool diameter 412 may be improve efficiency of the pump-down operation by reducing surface area in contact with the wellbore and providing increased cross-sectional surface area for the wellbore fluid to act against.

Figure 9:
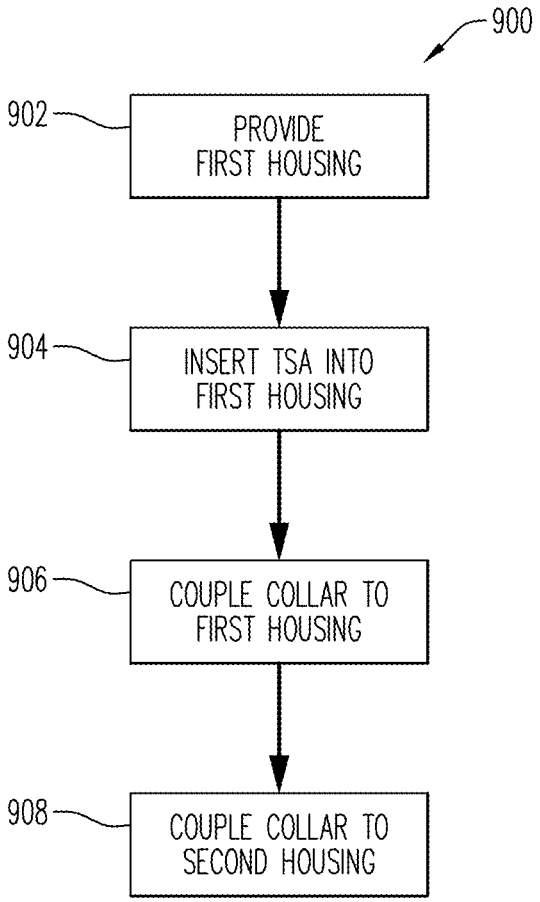
FIG. 9 is a flowchart illustrating a method of assembling a wellbore tool string according to an exemplary embodiment.

FIG. 9 shows an exemplary embodiment of a method 900 for assembling a wellbore tool string such as the wellbore tool string 106 (see FIG. 1). In block 902, the first housing 120 of the first wellbore tool 118 is provided. In block 904, the TSA 110 is inserted into the first housing 120 until the TSA rib 204 abuts with the first housing 120.

In block 906, the collar 114 is coupled to the first housing 120. The portion of the TSA 110 protruding from the first housing 120 may be passed through the interior of the collar 114 until the first collar coupling 306 starts to engage with the first tool coupling 402. In an exemplary embodiment in which the first collar coupling 306 and the first tool coupling 402 are complementary threads, the collar 114 and the first housing 120 may be rotated relative to each other until the collar 114 is securely coupled to the first housing 120, which may occur when the collar rib 302 abuts one or both of the TSA rib 204 and the first housing 120 (see FIG. 4A). In this configuration, a portion of the first housing 120 will be positioned between the TSA body 112 and the collar 114 in the radial direction 104.

In block 908, the collar 114 is coupled to the second housing 124 of the second wellbore tool 122. This may be achieved by inserting the second housing 124 into the collar 114 opposite the first housing 120 to engage the second collar coupling 308 and the second tool coupling 404 (see FIG. 4A). In an exemplary embodiment in which the second collar coupling 308 and the second tool coupling 404 are complementary threads, the collar 114 and the second wellbore tool 122 may be rotated relative to each other until the collar 114 is securely coupled to the second wellbore tool 122, which may occur when the second housing 124 abuts one or both of the TSA rib 204 and the collar rib 302.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B, and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine," "calculate," and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. An adapter assembly for use with a wellbore tool string, the adapter assembly comprising:

a tandem seal adapter (TSA), the TSA including a TSA body extending along an axial direction from a first end of the TSA body to a second end of the TSA body, and a TSA rib extending radially outward from the TSA body in a radial direction substantially perpendicular to the axial direction; and a collar, the collar being provided outward from the TSA in the radial direction, the collar including a collar body extending along an axial direction from a first end of the collar body to a second end of the collar body, the collar body being formed in a substantially annular shape, and a collar rib extending radially inward from the collar body in the radial direction, wherein the collar rib is positioned between the TSA rib and a housing of a wellbore tool in the axial direction.

2. The adapter assembly of claim 1, wherein the TSA rib abuts the collar rib in the axial direction.

3. The adapter assembly of claim 1, wherein the collar rib includes a first end surface and a second end surface spaced apart from the first end surface in the axial direction, the TSA rib is adjacent to the second end surface of the collar rib, and the housing is adjacent to the first end surface of the collar rib.

4. The adapter assembly of claim 1, wherein the collar rib defines a minimum inner diameter of the collar and the TSA rib defines a maximum outer diameter of the TSA.

5. The adapter assembly of claim 1, further comprising a bulkhead and a bulkhead seal, wherein the TSA further includes a bore extending through the TSA body from the first end of the TSA body to the second end of the TSA body, the bulkhead is received within the bore, and the bulkhead seal forms a pressure seal between the bulkhead and an inner surface of the bore, within the bore.

6. The adapter assembly of claim 5, wherein the bulkhead is configured to provide electrical connectivity between the first end of the TSA body and the second end of the TSA body.

7. The adapter assembly of claim 1, further comprising a seal, wherein the seal is disposed in a seal groove on an outer surface of the TSA body and the seal groove is positioned between the collar rib and the first end of the TSA body.

8. The adapter assembly of claim 7, wherein the housing overlaps the TSA body and the seal in the radial direction.

9. An adapter assembly for use with a wellbore tool string, the adapter assembly comprising:

a tandem seal adapter (TSA), the TSA including a TSA body extending along an axial direction from a first end of the TSA body to a second end of the TSA body, and a TSA rib extending radially outward from the TSA body in a radial direction substantially perpendicular to the axial direction; and a collar, the collar being provided outward from the TSA in the radial direction, the collar including a collar body extending along an axial direction from a first end of the collar body to a second end of the collar body, the collar body being formed in a substantially annular shape, and a collar rib extending radially inward from the collar body in the radial direction, wherein the TSA rib includes a TSA rib wall extending in the radial direction, the TSA rib wall defining a TSA rib wall surface, the collar rib includes a first end surface and a second end surface spaced apart from the first end surface in the axial direction, the TSA rib wall surface and the second end surface of the collar rib are in a facing relationship in the axial direction, and the first end surface of the collar rib is adjacent to a housing of a wellbore tool in the axial direction.

10. The adapter assembly of claim 9, wherein the first TSA rib wall surface abuts the second end surface of the collar rib.

11. The adapter assembly of claim 9, further comprising a bulkhead and a bulkhead seal, wherein the TSA further includes a bore extending through the TSA body from the first end of the TSA body to the second end of the TSA body, the bulkhead is received within the bore, and the bulkhead seal forms a pressure seal between the bulkhead and an inner surface of the bore, within the bore.

12. The adapter assembly of claim 11, wherein the bulkhead is configured to provide electrical connectivity between the first end of the TSA body and the second end of the TSA body.

13. The adapter assembly of claim 9, further comprising a seal, wherein the seal is positioned between the collar rib and the first end of the TSA body, and the housing overlaps the TSA body and the seal in the radial direction.

14. An adapter assembly for use with a wellbore tool string, the adapter assembly comprising:

a tandem seal adapter (TSA), the TSA including a TSA body extending along an axial direction from a first end of the TSA body to a second end of the TSA body, and a TSA rib extending radially outward from the TSA body in a radial direction substantially perpendicular to the axial direction; and a collar, the collar being provided outward from the TSA in the radial direction, the collar including a collar body extending along an axial direction from a first end of the collar body to a second end of the collar body, the collar body being formed in a substantially annular shape, a collar rib extending radially inward from the collar body in the radial direction, wherein the collar rib is positioned between the TSA rib and a housing of a wellbore tool in the axial direction and the housing overlaps the first end of the TSA body.

15. The adapter assembly of claim 14, further comprising a bulkhead and a bulkhead seal, wherein the TSA further includes a bore extending through the TSA body from the first end of the TSA body to the second end of the TSA body, the bulkhead is received within the bore, and the bulkhead seal forms a pressure seal between the bulkhead and an inner surface of the bore, within the bore.

16. The adapter assembly of claim 15, wherein the bulkhead is configured to provide electrical connectivity between the first end of the TSA body and the second end of the TSA body.

17. The adapter assembly of claim 14, wherein the TSA rib abuts the collar rib in the axial direction.

18. The adapter assembly of claim 14, wherein the collar rib includes a first end surface and a second end surface spaced apart from the first end surface in the axial direction, the TSA rib is adjacent to the second end surface of the collar rib, and the housing is adjacent to the first end surface of the collar rib.

19. The adapter assembly of claim 14, wherein the collar rib defines a minimum inner diameter of the collar and the TSA rib defines a maximum outer diameter of the TSA.

20. The adapter assembly of claim 14, further comprising a seal, wherein the seal is positioned between the collar rib and the first end of the TSA body and the housing overlaps the seal in the radial direction.

* * * * *